US010821318B2

(12) United States Patent
Saddler

(10) Patent No.: US 10,821,318 B2
(45) Date of Patent: Nov. 3, 2020

(54) EXERCISING ASSEMBLY

(71) Applicant: Freddy Saddler, Mansfield, OH (US)

(72) Inventor: Freddy Saddler, Mansfield, OH (US)

( * ) Notice: Subject to any disclaimer, the term of this patent is extended or adjusted under 35 U.S.C. 154(b) by 57 days.

(21) Appl. No.: 15/962,038

(22) Filed: Apr. 25, 2018

(65) Prior Publication Data

US 2019/0329090 A1 Oct. 31, 2019

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/06*** | (2006.01) |
| ***A63B 23/04*** | (2006.01) |
| ***A63B 24/00*** | (2006.01) |
| ***A63B 23/035*** | (2006.01) |

(52) U.S. Cl.

CPC ..... *A63B 21/4045* (2015.10); *A63B 21/023* (2013.01); *A63B 21/0428* (2013.01); *A63B 21/06* (2013.01); *A63B 21/4034* (2015.10); *A63B 21/4035* (2015.10); *A63B 23/03525* (2013.01); *A63B 23/04* (2013.01); *A63B 24/0062* (2013.01)

(58) Field of Classification Search

CPC ... A63B 21/02; A63B 21/023; A63B 21/0428; A63B 21/0522; A63B 21/0557; A63B 21/4031; A63B 21/4043; A63B 21/404; A63B 21/4045; A63B 21/06; A63B 21/4035; A63B 21/4034; A63B 2022/0033; A63B 2022/0035; A63B 2022/206; A63B 22/20; A63B 22/201; A63B 22/203; A63B 22/205; A63B 22/0076–0089; A63B 23/02–0244; A63B 23/03525; A63B 23/04; A63B 2208/0214; A63B 2208/0219; A63B 24/0062

See application file for complete search history.

(56) References Cited

U.S. PATENT DOCUMENTS

| | | | | |
|---|---|---|---|---|
| 3,130,968 A * | 4/1964 | De Feen | A63B 23/00 | 482/132 |
| 5,876,311 A * | 3/1999 | Coates | A47C 3/0252 | 297/274 |
| 5,906,564 A * | 5/1999 | Jacobsen | A63B 23/1209 | 482/96 |
| 7,455,633 B2 * | 11/2008 | Brown | A63B 21/068 | 482/140 |
| 7,585,263 B2 | 9/2009 | Brown et al. | | |
| 7,780,585 B1 * | 8/2010 | Rivas | A63B 21/0552 | 482/140 |

(Continued)

*Primary Examiner* — Jennifer Robertson
*Assistant Examiner* — Kathleen Vermillera

(57) ABSTRACT

An exercising assembly for simultaneously exercising muscles of the abdomen and legs includes a glider that is slidably coupled to a frame. A biaser that is coupled to the frame and the glider biases the glider to a front of the frame. A leg plate is coupled to and selectively extensible from the glider. An elbow plate, which is padded, is coupled to and selectively extensible from the front of the frame. A pair of handles is coupled to the elbow plate and is configured to be grasped in hands of a user. The user's elbows are positioned on the elbow plate and the user's legs are positioned on the leg plate. The user is positioned to push the glider from the front to a back of the frame to exercise abdominal and leg muscles of the user.

18 Claims, 5 Drawing Sheets

(56) References Cited

U.S. PATENT DOCUMENTS

| | | | | |
|---|---|---|---|---|
| 7,938,763 | B2 * | 5/2011 | Campanaro | A63B 21/068 482/140 |
| 8,721,510 | B2 | 5/2014 | Chung-Ting et al. | |
| 8,888,661 | B2 | 11/2014 | Ellis | |
| 9,028,376 | B2 * | 5/2015 | Ho | A63B 22/205 482/131 |
| 9,138,606 | B2 * | 9/2015 | Lagree | A63B 21/055 |
| D787,614 | S | 5/2017 | Zhu | |
| 10,046,193 | B1 * | 8/2018 | Aronson | A63B 21/025 |
| 2004/0192521 | A1 * | 9/2004 | Nizamuddin | A63B 21/00047 482/142 |
| 2008/0200317 | A1 * | 8/2008 | Campanaro | A63B 21/068 482/140 |
| 2012/0225758 | A1 * | 9/2012 | Shaw | A63B 21/0004 482/110 |
| 2013/0065736 | A1 * | 3/2013 | Chen | A63B 21/068 482/96 |
| 2017/0014667 | A1 * | 1/2017 | Barnett | A63B 21/4035 |
| 2018/0117388 | A1 * | 5/2018 | Porter | A63B 21/4033 |
| 2019/0160331 | A1 * | 5/2019 | Mercenari Uribe | A63B 21/008 |

* cited by examiner

EXERCISING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exercising assemblies and more particularly pertains to a new exercising assembly for simultaneously exercising muscles of the abdomen and legs.

BRIEF SUMMARY OF THE INVENTION

An embodiment of the disclosure meets the needs presented above by generally comprising a glider that is slidably coupled to a frame. A biaser that is coupled to the frame and the glider biases the glider to a front of the frame. A leg plate is coupled to and selectively extensible from the glider. An elbow plate, which is padded, is coupled to and selectively extensible from the front of the frame. A pair of handles is coupled to the elbow plate and is configured to be grasped in hands of a user. The user's elbows are positioned on the elbow plate and the user's legs are positioned on the leg plate. The user is positioned to push the glider from the front to a back of the frame to exercise abdominal and leg muscles of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
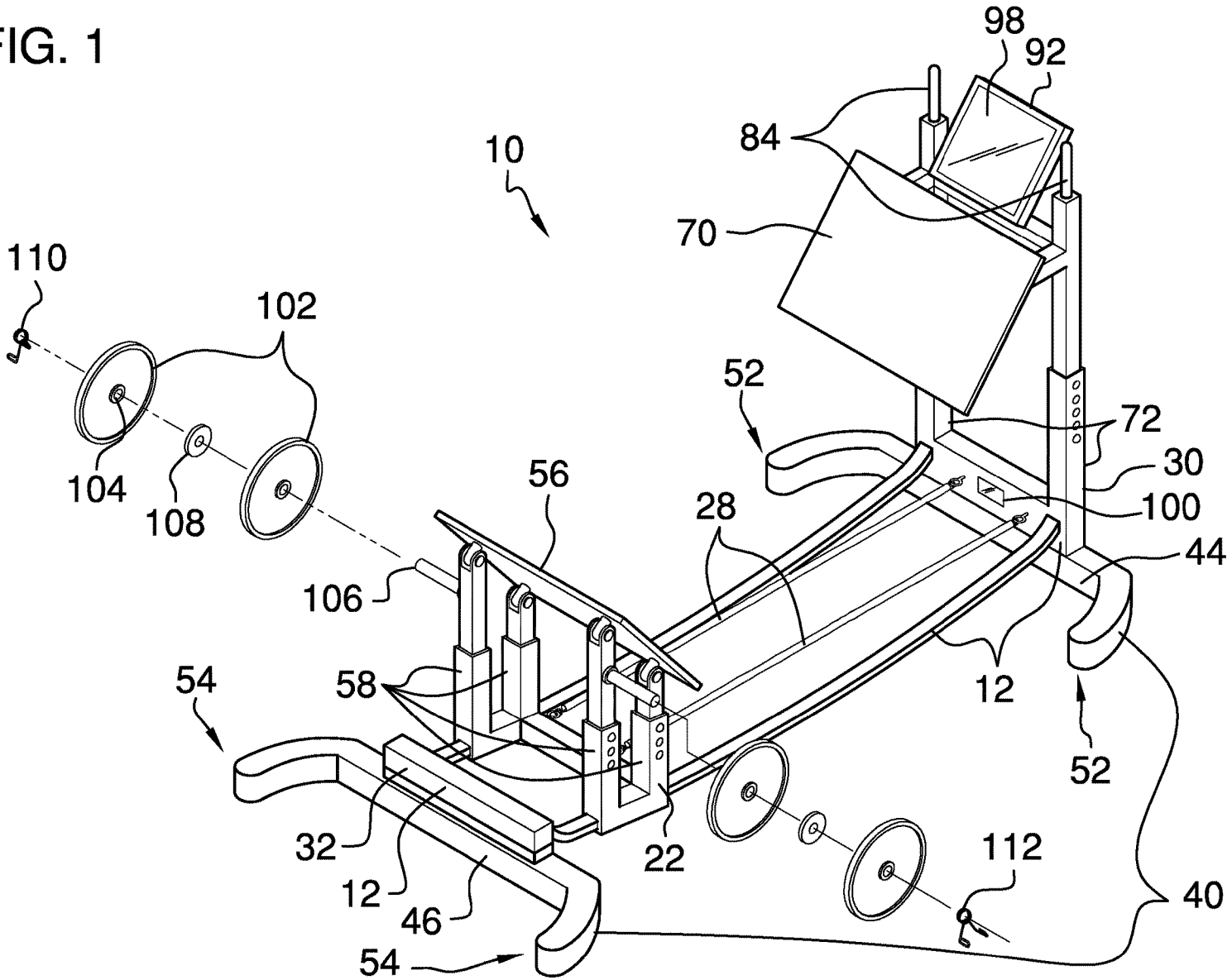
FIG. 1 is an isometric perspective view of an exercising assembly according to an embodiment of the disclosure.

With reference now to the drawings, and in particular to FIGS. 1 through 5 thereof, a new exercising assembly embodying the principles and concepts of an embodiment of the disclosure and generally designated by the reference numeral 10 will be described.

Figure 2:
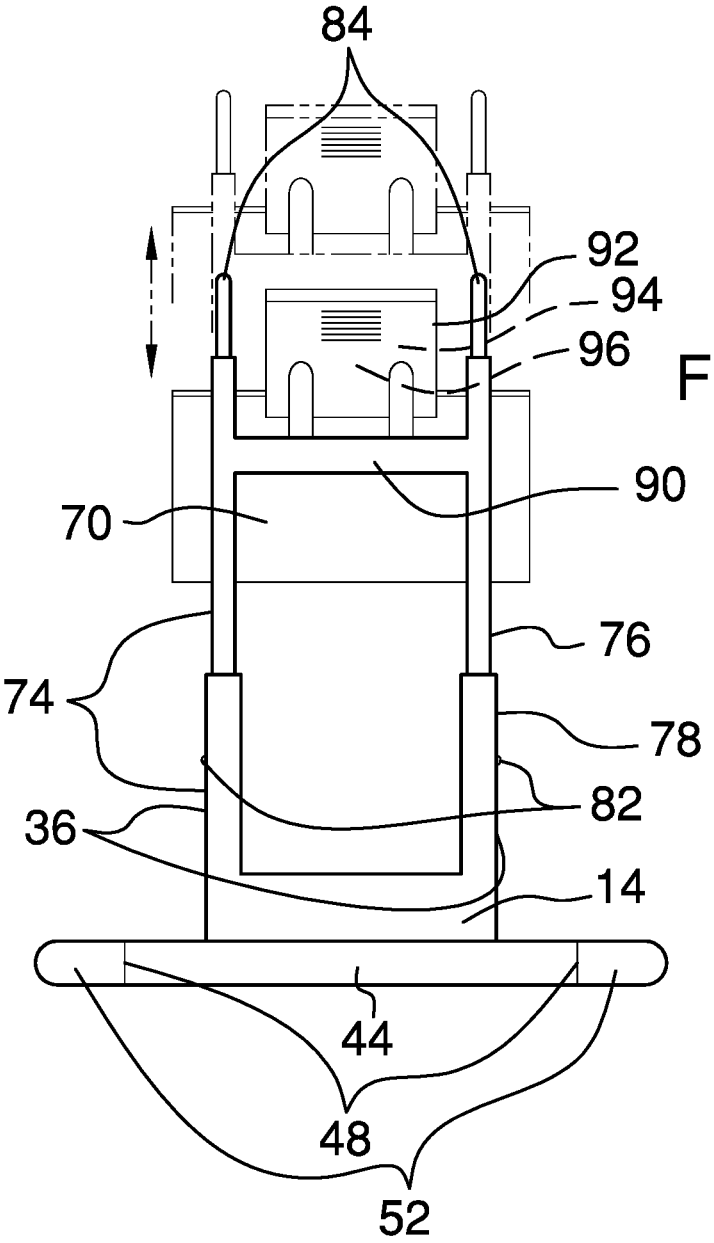
FIG. 2 is a front view of an embodiment of the disclosure.
Figure 3:
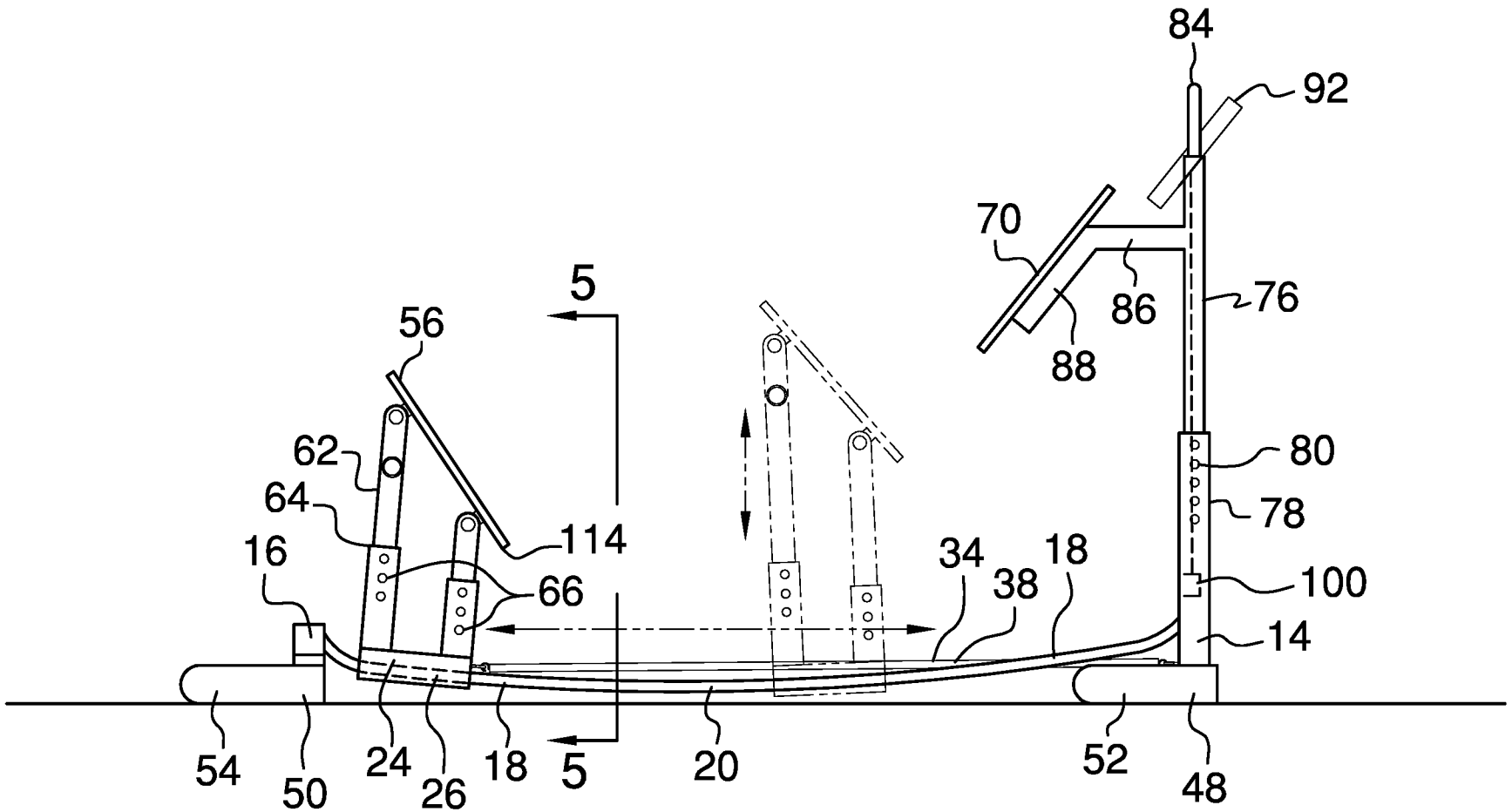
FIG. 3 is a side view of an embodiment of the disclosure.

As best illustrated in FIGS. 1 through 5, the exercising assembly 10 generally comprises a frame 12. The frame 12 comprises a front bar 14, a back bar 16, and a pair of slide rods 18. Each slide rod 18 is coupled to and extends between the front bar 14 and the back bar 16 so that the frame 12 is rectangularly shaped, as shown in FIG. 1. The slide rods 18 are arcuate so that a center section 20 of each slide rod 18 is positioned closer to a horizontal surface upon which the frame 12 is positioned, as shown in FIG. 3. The slide rods 18 are rectangularly shaped when viewed longitudinally.

A glider 22 is slidably coupled to the frame 12. The glider 22 is slidable between a front 30 and a back 32 of the frame 12. The glider 22 comprises a pair of slide bars 24. Each of a pair of channels 26 is positioned longitudinally through a respective slide bar 24. Each slide rod 18 is complementary to and slidably positioned in a respective channel 26.

A biaser 28 is coupled to the frame 12 and the glider 22 so that the glider 22 is biased to the front 30 of the frame 12. The biaser 28 comprises a pair of springs 34, as shown in FIG. 1. Each spring 34 is coupled to and extends between the frame 12 and the glider 22. The springs 34 are positioned singly proximate to opposing sides 36 of the frame 12. Each of a pair of sleeves 38 is positioned over a respective spring 34.

A base 40 is coupled to a bottom 42 of the frame 12, as shown in FIG. 1. The base 40 is positioned to elevate the frame 12 from a horizontal surface. The base 40 comprises a first footing bar 44 and a second footing bar 46. The first footing bar 44 is coupled to the front 30 of the frame 12 so that opposing endpoints 48 of the first footing bar 44 extend past the opposing sides 36 of the frame 12. The second footing bar 46 is coupled to the back 32 of the frame 12 so that opposing termini 50 of the second footing bar 46 extend past the opposing sides 36 of the frame 12.

Figure 4:
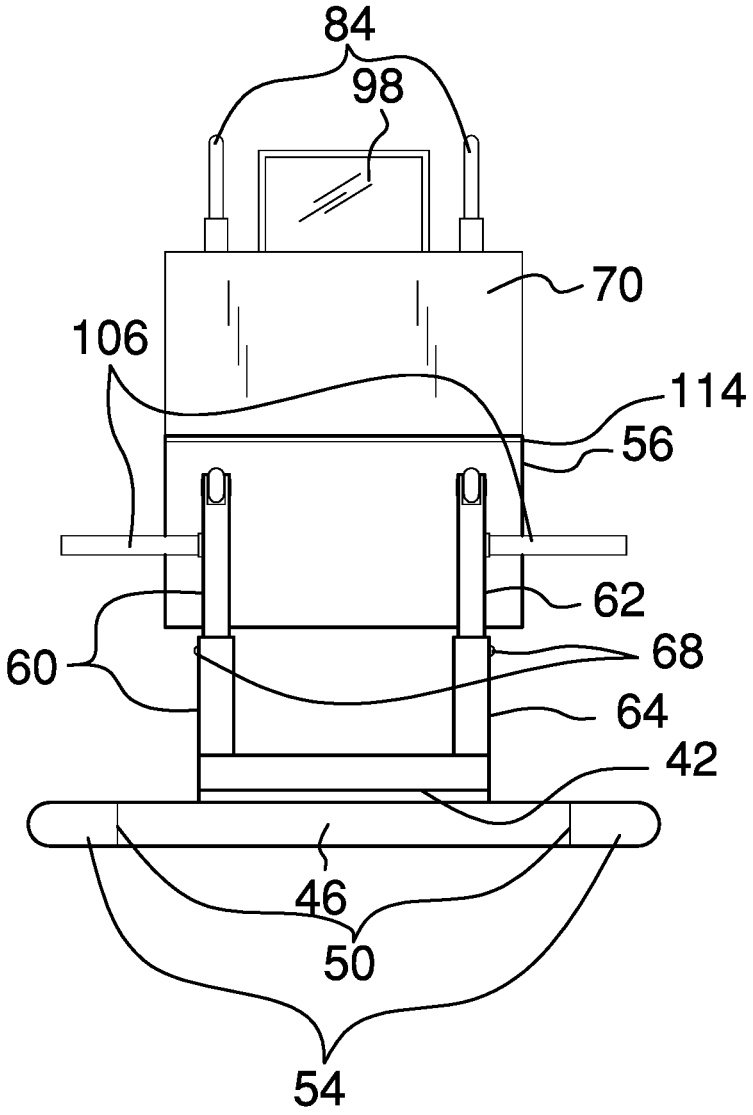
FIG. 4 is a back view of an embodiment of the disclosure.
Figure 5:
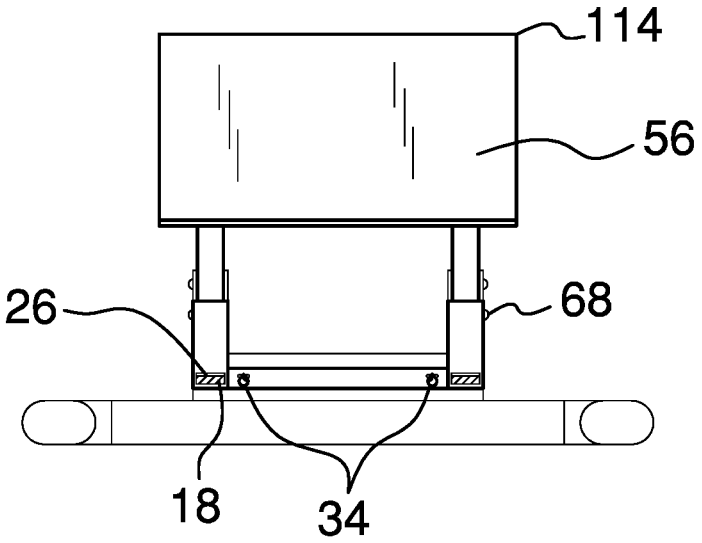
FIG. 5 is a cross-sectional view of an embodiment of the disclosure.

Each of a pair of first extensions 52 is coupled to and extends arcuately from a respective opposing endpoint 48 of the first footing bar 44 toward the back 32 of the frame 12, as shown in FIG. 2. Each of a pair of second extensions 54 is coupled to and extends arcuately from a respective opposing terminus 50 of the second footing bar 46 away from the frame 12, as shown in FIG. 4.

A leg plate 56 is coupled to and is selectively extensible from the glider 22. The leg plate 56 is padded. The leg plate 56 is substantially rectangularly shaped. Each of a set of four first tubes 58 is coupled to and extends between a respective corner 114 of the leg plate 56 and an associated slide bar 24. Each first tube 58 is perpendicular to the associated slide bar 24. Each first tube 58 comprises a plurality of nested sections 60 so that the first tubes 58 are selectively extensible from the slide bars 24, as shown in FIG. 3. The leg plate 56 is pivotally coupled to each first tube 58 distal from the slide bars 24 so that the leg plate 56 is angularly positionable relative to the frame 12. The plurality of nested sections 60 comprises an upper section 62 and a lower section 64.

Each of four sets of holes 66 is positioned in the lower section 64 of a respective first tube 58, as shown in FIG. 3. Each set of holes 66 comprises three holes. Each of a set of first pins 68 is coupled to the upper section 62 of a respective first tube 58. The first pins 68 are spring loaded. The first pin 68 is selectively alignable with and insertable into a respective hole 66 that is positioned in the lower section 64 of the respective first tube 58. The upper section 62 is coupled to the lower section 64 to fixedly position the leg plate 56 relative to the slide bars 24.

An elbow plate 70 is coupled to and selectively extensible from the front 30 of the frame 12. The elbow plate 70 is padded. The elbow plate 70 is substantially rectangularly shaped.

Each of a pair of second tubes 72 is coupled to and extends perpendicularly from a respective opposing side 36 of the frame 12 adjacent to the front 30 of the frame 12. Each second tube 72 comprises a plurality of nested segments 74 so that the second tube 72 is selectively extensible from the frame 12, as shown in FIG. 3. The plurality of nested segments 74 includes an upper segment 76 and a lower segment 78.

Each of two sets of orifices 80 is positioned in the lower segment 78 of a respective second tube 72, as shown in FIG. 3. Each set of orifices 80 comprises five orifices. Each of a pair of second pins 82 is coupled to the upper segment 76 of a respective second tube 72. The second pins 82 are spring loaded. The second pin 82 is selectively alignable with and insertable into a respective orifice 80 that is positioned in the lower segment 78 of the respective second tube 72 to couple the upper segment 76 to the lower segment 78.

A pair of handles 84 is coupled singly to the second tubes 72 distal from the frame 12, as shown in FIG. 2. The handles 84 are configured to be grasped in hands of a user. The user's elbows are positioned on the elbow plate 70 and the user's legs are positioned on the leg plate 56. The user is positioned to push the glider 22 from the front 30 to the back 32 of the frame 12 to exercise abdominal and leg muscles of the user. The biaser 28 urges the glider 22 to return to the front 30 of the frame 12 when the user ceases pushing on the leg plate 56.

Each of a pair of arms 86 is coupled to and extends perpendicularly from a respective second tube 72 distal from the frame 12, as shown in FIG. 3. The arms 86 extend toward the back 32 of the frame 12. Each of a pair of armbars 88 is coupled to and extends transversely from a respective arm 86 distal from the second tube 72. The armbars 88 extend toward the frame 12. The elbow plate 70 is coupled to and extends between the armbars 88.

A crossbar 90 is coupled to and extends between the pair of second tubes 72 distal from the frame 12, as shown in FIG. 3. A display module 92 is coupled to the crossbar 90. The display module 92 comprises a power module 94, a microprocessor 96, and a screen 98. The microprocessor 96 is operationally coupled to the power module 94. The screen 98 is operationally coupled to the microprocessor 96.

A sensor 100 is coupled to the frame 12, as shown in FIG. 1. The sensor 100 is operationally coupled to the display module 92. The sensor 100 is positioned to register a cycle of the glider 22 moving away from and returning to the front 30 of the frame 12. The sensor 100 is positioned so as to signal the microprocessor 96 of a completion of a cycle by the user, wherein the microprocessor 96 will then signal the screen 98 to present the total completed number of cycles to the user.

The assembly 10 comprises a plurality of weights 102, as shown in FIG. 1. Each weight 102 has a respective mass so that the plurality of weights 102 comprises weights that have a variety of masses. The weights 102 are selectively couplable to the glider 22 to increase resistance to movement of the glider 22 from the front 30 toward the back 32 of the frame 12. Each weight 102 is disc shaped and has a center hole 104.

Each of a pair of support rods 106 is coupled to and extends from a respective first tube 58 so that the support rod 106 extends outwardly from an associated opposing side 36 of the frame 12, as shown in FIG. 4. The support rods 106 are positioned on the first tubes 58 that are positioned proximate to the back 32 of the frame 12. The support rod 106 is positioned to insert into a respective center hole 104 to couple an associated weight 102 to the glider 22.

Each of a plurality of rings 108 is positioned to insertably couple to a respective support rod 106 so that the ring 108 is positioned between adjacently positioned weights 102. Each of a pair of fasteners 110 is selectively couplable to a respective support rod 106 to retain the respective weight 102 on the support rod 106. Each fastener 110 comprises a spring clamp 112.

In use, the user couples the weights 102 to the support rods 106 to obtain a desired level of resistance to movement of the glider 22 from the front 30 to the back 32 of the frame 12. With the user's elbows positioned on the elbow plate 70 and the user's legs positioned on the leg plate 56, the user is positioned to push the glider 22 from the front 30 to the back 32 of the frame 12 to exercise the abdominal and the leg muscles of the user. The biaser 28 urges the glider 22 to return to the front 30 of the frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. An exercising assembly comprising:

a frame, said frame comprising a front bar, a back bar, and a pair of slide rods, each said slide rod being coupled to and extending between said front bar and said back bar such that said frame is rectangularly shaped, said slide rods being arcuate such that a center section of each said slide rod is configured to be positioned closer to a horizontal surface upon which said frame is positioned relative to a first end and a second end of each said slide rod, said slide rods being rectangularly shaped when viewed longitudinally;

a glider slidably coupled to said frame such that said glider is slidable between a front and a back of said frame;

a biaser coupled to said frame and said glider such that said glider is biased to said front of said frame;

a leg plate coupled to and selectively extensible from said glider;

an elbow plate coupled to and selectively extensible from said front of said frame, said elbow plate being padded;

a pair of handles coupled to said elbow plate wherein said handles are configured for grasping in hands of a user having elbows positioned on said elbow plate and legs positioned on said leg plate wherein the user is positioned for pushing said glider from said front to said back of said frame for exercising abdominal and leg muscles of the user;

a first tube, said first tube being coupled to and extending from a corner of said leg plate; and a pair of second tubes, each said second tube being coupled to and extending perpendicularly from a respective opposing side of said frame adjacent to said front of said frame, each said second tube comprising a plurality of nested segments such that said second tube is selectively extensible from said frame; said handles being coupled to respective said second tubes distal from said frame.

2. The assembly of claim 1, further including a base coupled to a bottom of said frame wherein said base is positioned for elevating said frame from a horizontal surface.

3. The assembly of claim 2, further including said base comprising:

a first footing bar coupled to said front of said frame such that opposing endpoints of said first footing bar extend past opposing sides of said frame; and a second footing bar coupled to said back of said frame such that opposing termini of said second footing bar extend past said opposing sides of said frame.

4. The assembly of claim 3, further comprising:

a pair of first extensions, each said first extension being coupled to and extending arcuately from a respective said opposing endpoint of said first footing bar toward said back of said frame; and a pair of second extensions, each said second extension being coupled to and extending arcuately from a respective said opposing terminus of said second footing bar away from said frame.

5. The assembly of claim 1, further including said biaser comprising a pair of springs, each said spring being coupled to and extending between said frame and said glider, said springs being positioned proximate to opposing sides of said frame.

6. The assembly of claim 5, further including a pair of sleeves, each said sleeve being positioned over a respective said spring.

7. The assembly of claim 1, further including said glider comprising:

a pair of slide bars; and a pair of channels, each said channel being positioned longitudinally through a respective said slide bar, each said slide rod being complementary to and slidably positioned in a respective said channel.

8. The assembly of claim 1, further including said leg plate being padded, said leg plate and said elbow plate being substantially rectangularly shaped.

9. The assembly of claim 1, further comprising:

said plurality of nested segments of each second tube comprising an upper segment and a lower segment;

two sets of orifices, each said set of orifices being positioned in said lower segment of a respective said second tube, each said set of orifices comprising five orifices; and a pair of pins, said pins being spring loaded, each said pin being coupled to said upper segment of a respective said second tube such that said pin is selectively alignable with and insertable into a respective said orifice positioned in said lower segment of said respective said second tube wherein said upper segment is coupled to said lower segment.

10. The assembly of claim 1, further comprising:

a pair of arms, each said arm being coupled to and extending perpendicularly from a respective said second tube distal from said frame such that said arms extend toward said back of said frame; and a pair of armbars, each said armbar being coupled to and extending transversely from a respective said arm distal from said second tube such that said armbars extend toward said frame, said elbow plate being coupled to and extending between said armbars.

11. The assembly of claim 1, further comprising:

a crossbar coupled to and extending between said pair of second tubes distal from said frame;

a display module coupled to said crossbar, said display module comprising a microprocessor, and a screen, said screen being operationally coupled to said microprocessor; and a sensor coupled to said frame, said sensor being operationally coupled to said display module wherein said sensor is positioned for registering a cycle of said glider moving away from and returning to said front of said frame.

12. An exercising assembly comprising:

a frame, said frame comprising a front bar, a back bar, and a pair of slide rods, each said slide rod being coupled to and extending between said front bar and said back bar such that said frame is rectangularly shaped, said slide rods being arcuate such that a center section of each said slide rod is configured to be positioned closer to a horizontal surface upon which said frame is positioned relative to a first end and a second end of each said slide rod, said slide rods being rectangularly shaped when viewed longitudinally;

a glider slidably coupled to said frame such that said glider is slidable between a front and a back of said frame, said glider comprising a pair of slide bars, and a pair of channels, each said channel being positioned longitudinally through a respective said slide bar, each said slide rod being complementary to and slidably positioned in a respective said channel;

a biaser coupled to said frame and said glider such that said glider is biased to said front of said frame;

a leg plate coupled to and selectively extensible from said glider;

an elbow plate coupled to and selectively extensible from said front of said frame, said elbow plate being padded; and a pair of handles coupled to said elbow plate wherein said handles are configured for grasping in hands of a user having elbows positioned on said elbow plate and legs positioned on said leg plate wherein the user is positioned for pushing said glider from said front to said back of said frame for exercising abdominal and leg muscles of the user; and a set of four first tubes, each said first tube being coupled to and extending between a respective corner of said leg plate and an associated said slide bar, each said first tube being perpendicular to said associated said slide bar, said leg plate being pivotally coupled to each said first tube distal from said slide bars, each said first tube comprising a plurality of nested sections such that said first tubes are selectively extensible from said slide bars and said leg plate is angularly positionable relative to said frame.

13. The assembly of claim 12, further including a plurality of weights, each said weight having a respective mass such that said plurality of weights comprises weights having a variety of masses, said weights being selectively couplable to said glider for increasing resistance to movement of said glider from said front toward said back of said frame.

14. The assembly of claim 13, further comprising:

each said weight being disc shaped, each said weight have a center hole;

a pair of support rods, each said support rod being coupled to and extending from a respective said first tube such that said support rod extends outwardly from an associated opposing side of said frame wherein said support rod is positioned for inserting into a respective center hole for coupling to an associated said weight to said glider;

a plurality of rings, each said ring being positioned for insertably coupling to a respective said support rod such that said ring is positioned between adjacently positioned said weights; and a pair of fasteners, each said fastener being selectively couplable to a respective said support rod for retaining said associated said weight on said support rod.

15. The assembly of claim 14, further including said support rods being positioned on said first tubes positioned proximate to said back of said frame.

16. The assembly of claim 14, further including each said fastener comprising a spring clamp.

17. The assembly of claim 12, further comprising:

said plurality of nested sections of each first tube comprising an upper section and a lower section;

four sets of holes, each said set of holes being positioned in said lower section of a respective said first tube, each said set of holes comprising three holes; and a set of first pins, said first pins being spring loaded, each said first pin being coupled to said upper section of a respective said first tube such that said first pin is selectively alignable with and insertable into a respective said hole positioned in said lower section of said respective said first tube wherein said upper section is coupled to said lower section for fixedly positioning said leg plate relative to said slide bars.

18. An exercising assembly comprising:

a frame, said frame comprising:

a front bar, a back bar, and a pair of slide rods, each said slide rod being coupled to and extending between said front bar and said back bar such that said frame is rectangularly shaped, said slide rods being arcuate such that a center section of each said slide rod is configured to be positioned closer to a horizontal surface upon which said frame is positioned relative to a first end and a second end of each said slide rod, said slide rods being rectangularly shaped when viewed longitudinally;

a glider slidably coupled to said frame such that said glider is slidable between a front and a back of said frame, said glider comprising:

a pair of slide bars, and a pair of channels, each said channel being positioned longitudinally through a respective said slide bar, each said slide rod being complementary to and slidably positioned in a respective said channel;

a biaser coupled to said frame and said glider such that said glider is biased to said front of said frame, said biaser comprising a pair of springs, each said spring being coupled to and extending between said frame and said glider, said springs being positioned singly proximate to opposing sides of said frame;

a base coupled to a bottom of said frame wherein said base is positioned for elevating said frame from said horizontal surface, said base comprising:

a first footing bar coupled to said front of said frame such that opposing endpoints of said first footing bar extend past said opposing sides of said frame, a second footing bar coupled to said back of said frame such that opposing termini of said second footing bar extend past said opposing sides of said frame, a pair of first extensions, each said first extension being coupled to and extending arcuately from a respective said opposing endpoint of said first footing bar toward said back of said frame, and a pair of second extensions, each said second extension being coupled to and extending arcuately from a respective said opposing terminus of said second footing bar away from said frame;

a pair of sleeves, each said sleeve being positioned over a respective said spring;

a leg plate coupled to and selectively extensible from said glider, said leg plate being padded, said leg plate being substantially rectangularly shaped;

a set of four first tubes, each said first tube being coupled to and extending between a respective corner of said leg plate and an associated said slide bar, each said first tube being perpendicular to said associated said slide bar, said leg plate being pivotally coupled to each said first tube distal from said slide bars, each said first tube comprising a plurality of nested sections such that said first tubes are selectively extensible from said slide bars and said leg plate is angularly positionable relative to said frame, said plurality of nested sections comprising an upper section and a lower section;

four sets of holes, each said set of holes being positioned in said lower section of a respective said first tube, each said set of holes comprising three holes;

a set of first pins, said first pins being spring loaded, each said first pin being coupled to said upper section of a respective said first tube such that said first pin is selectively alignable with and insertable into a respective said hole positioned in said lower section of said respective said first tube wherein said upper section is coupled to said lower section for fixedly positioning said leg plate relative to said slide bars;

an elbow plate coupled to and selectively extensible from said front of said frame, said elbow plate being padded, said elbow plate being substantially rectangularly shaped;

a pair of second tubes, each said second tube being coupled to and extending perpendicularly from a respective said opposing side of said frame adjacent to said front of said frame, each said second tube comprising a plurality of nested segments such that said second tube is selectively extensible from said frame, said plurality of nested segments comprising an upper segment and a lower segment;

two sets of orifices, each said set of orifices being positioned in said lower segment of a respective said second tube, each said set of orifices comprising five orifices;

a pair of second pins, said second pins being spring loaded, each said second pin being coupled to said upper segment of a respective said second tube such that said second pin is selectively alignable with and insertable into a respective said orifice positioned in said lower segment of said respective said second tube wherein said upper segment is coupled to said lower segment;

a pair of handles coupled to said elbow plate wherein said handles are configured for grasping in hands of a user having elbows positioned on said elbow plate and legs positioned on said leg plate wherein the user is positioned for pushing said glider from said front to said back of said frame for exercising abdominal and leg muscles of the user, said handles being coupled to respective said second tubes distal from said frame;

a pair of arms, each said arm being coupled to and extending perpendicularly from a respective said second tube distal from said frame such that said arms extend toward said back of said frame;

a pair of armbars, each said armbar being coupled to and extending transversely from a respective said arm distal from said second tube such that said armbars extend toward said frame, said elbow plate being coupled to and extending between said armbars;

a crossbar coupled to and extending between said pair of second tubes distal from said frame;

a display module coupled to said crossbar, said display module comprising a microprocessor, and a screen, said screen being operationally coupled to said microprocessor;

a sensor coupled to said frame, said sensor being operationally coupled to said display module wherein said sensor is positioned for registering a cycle of said glider moving away from and returning to said front of said frame;

a plurality of weights, each said weight having a respective mass such that said plurality of weights comprises weights having a variety of masses, said weights being selectively couplable to said glider for increasing resistance to movement of said glider from said front toward said back of said frame, each said weight being disc shaped, each said weight have a center hole;

a pair of support rods, each said support rod being coupled to and extending from a respective said first tube such that said support rod extends outwardly from an associated said opposing side of said frame wherein said support rod is positioned for inserting into a respective center hole for coupling to an associated said weight to said glider, said support rods being positioned on said first tubes proximate to said back of said frame;

a plurality of rings, each said ring being positioned for insertably coupling to a respective said support rod such that said ring is positioned between adjacently positioned said weights; and a pair of fasteners, each said fastener being selectively couplable to a respective said support rod for retaining said respective said weight on said support rod, each said fastener comprising a spring clamp.

* * * * *